United States Patent [19]

Skei et al.

[11] Patent Number: 4,669,709

[45] Date of Patent: Jun. 2, 1987

[54] DEVICE FOR THE INJECTION OF GASES INTO MOLTEN METALS AND MINERALS

[75] Inventors: Bjarne Skei; Nils Pettersen, both of Notodden, Norway

[73] Assignee: Tinfos Jernverk A/S, Notodden, Norway

[21] Appl. No.: 846,460

[22] PCT Filed: Jun. 21, 1985

[86] PCT No.: PCT/NO85/00038

§ 371 Date: Apr. 9, 1986

§ 102(e) Date: Apr. 9, 1986

[87] PCT Pub. No.: WO86/00695

PCT Pub. Date: Jan. 30, 1986

[30] Foreign Application Priority Data

Jul. 4, 1984 [NO] Norway ..... 842705

[51] Int. Cl.[4] ..... C21C 5/34

[52] U.S. Cl. ..... 266/270; 266/265

[58] Field of Search ..... 266/218, 220, 265, 266, 266/270

[56] References Cited

U.S. PATENT DOCUMENTS 3,834,685 9/1974 Ziemkiewicz et al. ..... 266/220

FOREIGN PATENT DOCUMENTS 0070197 1/1983 European Pat. Off. .

105868 4/1984 European Pat. Off. ..... 266/220

2503672 9/1975 Fed. Rep. of Germany ..... 266/270

1555947 1/1969 France ..... 266/220

2096290 10/1982 United Kingdom ..... 266/265

*Primary Examiner*—L. Dewayne Rutledge

*Assistant Examiner*—Robert L. McDowell

*Attorney, Agent, or Firm*—Wenderoth, Lind & Ponack

[57] ABSTRACT

A device for injecting gas into a hot melt, particularly molten metal, is suitable for being installed in the wall, particularly the bottom wall, of the container holding the melt. The device has three main sections including a front section of refractory material which is resistant to the melt in question, and which has a number of perforations (10) for introduction of gas into the melt, a middle section which at least partly consists of heat conductive material and possesses a number of perforations communicating with the perforations of the front section, and a rear section at least the outer (peripheral) part of which is of heat conducting material, which rear section in or close to its peripheral part has a helical duct communicating with the perforations of the middle section and adapted to pass the gas from an external gas source.

The middle section is preferably divided into two part sections of which at least one, preferably the foremost part section, is made of a material of high heat conductivity, preferably copper or a copper alloy, whereas the rear part section preferably is of steel.

10 Claims, 3 Drawing Figures

DEVICE FOR THE INJECTION OF GASES INTO MOLTEN METALS AND MINERALS

BACKGROUND OF THE INVENTION

The present invention relates to a device for injecting gases into molten metal, alloys, minerals and the like, e.g. steel, aluminum, silicon, silicon alloys, to thereby honogenize, refine or in other ways treat the molten material.

The treatment of melts, particularly metal melts, with gases is well known within industry, and may have several different aims, e.g. stripping of undesirable, completely or partly dissolved gases from the melt, oxidation or reduction of some of the components of the melt to completely or partly eliminate these, e.g. as slag-forming oxides or volatile oxides; or gaseous reactants which are blown into the melt are intended to react with components thereof forming new, desired components of the melt. Many different, and partly specific, aims of gas treatment of metal melts are disclosed in the litterature. Examples are shown in Swedish Patent Publications Nos. 375 122; 395 912 and 413 327; and French Pat. Nos. 2 013 546 and 2 012 305.

Several of the well known devices for the above mentioned purpose comprise a porous, refractory body which is permeable to the gas to be injected or blown in, but not permeable to the molten material which is to be gas treated, whereby the porous body prevents draining of the melt.

One of the drawbacks of porous bodies is that they possess relatively high resistance to penetration of gas and thus relatively low capacity in this respect.

When relatively great amounts of gas are to be injected, injecting devices are suitably used by which the gas is injected via one or several tubes or borings in the device. The above mentioned problem of preventing the molten material from penetrating into the injection device must also in this case be solved. If not, there will be a risk of great drawbacks and frequent replacements of the injection device. A conventional solution of said problem is to circulate cooling fluid through part of the injection device whereby melt penetrating into the device from the container solidifies and prevents the outflow of the melt. Such an injection device is disclosed by DE-PS No. 2 503 672. With respect to embodiments of constructions of injection devices reference is further, more generally, made to e.g. DE-PS Nos. 1 508 263B and 1 508 282B and SE-PS No. 301 733B.

SUMMARY OF THE INVENTION

During the work of development of the injection device according to the invention the aim has been to provide an improved device for injecting gases into molten metals, alloys etc. (in the following for the sake of brevity called "the melt") contained in any container, reactor, ladle or the like, and where the device is mounted in the wall lining of the container beneath the bath level or preferably in its bottom lining.

Among the requirements to be met by the device the following are mentioned more particularly:

(a) High degree of safety against the melt flowing out via the injection device.

(b) Effective dispersion of injected gas in the melt.

(c) High degree of capacity flexibility.

(d) Long working life of the injection device.

(e) Possibility of convenient and quick replacement of the injection device from outside.

(f) Flexible adaptability to different containers/ladles/reactors and thickness of linings.

The injection device of the invention, which has been found to fulfil these requirements in a very satisfying way, comprises three main sections.

(1) a front section of refractory material which is also resistant to the melt in question and which has a number of perforations for supplying gas to the melt, (2) a middle section which at least partly consists of heat conducting material and has a number of perforations communicating with the perforations of the front section, (3) a rear section wherein at least the outer (peripheral) part is made of heat conducting material, which rear section in or adjacent to its peripheral parts has a helical duct communicating with perforations of the middle section and being provided to convey said gas from an external gas source.

According to a preferred embodiment of the invention the front section is divided into two part sections of which at least the foremost part section is made of refractory material, and wherein the perforations of the foremost part section are communicating with the perforations of the other (rear) part section through a cavity.

Another preferred embodiment provides that the middle section is divided into two part sections, of which at least one, preferably the foremost part section, is made of a material of high thermal conductivity. The foremost part section of the middle section preferably comprises copper or a copper alloy. The rear part section of the middle section preferably comprises steel.

According to a further preferred embodiment the perforations of the middle section are lined with piping of a material of a high resistance to chemical attack by the treatment gas.

According to another preferred embodiment of the invention the rear section comprises a central core and an outer or peripheral part surrounding the core and the foremost end of which extends past the core.

The helical duct of the rear section is preferably formed by a helical groove in the walls of the core. The helical duct of the rear section is preferably adapted to communicate with the perforations of the middle section through a cavity in the foremost part of the rear section.

According to a further preferred embodiment of the invention the rear (lower) part of the middle section and the foremost (upper) part of the rear section are provided with threads for screwing the two sections together.

During gas injection into metal melts, particularly melts of relatively high temperature, such as steel melts and ferro alloy melts, through injection devices which are inserted in the wall or bottom lining of the melt container, the injection device and particularly the part thereof which during operation is in contact with the melt will be exposed to great stresses. The most highly exposed parts thus have a limited life of operation. Interruption of operations for replacing one or more parts of the device should of course be minimised. The device of the invention has in operation proved to be particularly reliable and has led to a strongly reduced need for repair and replacement work, and the device is thus considered to represent a technical advance of the art.

The invention will be more readily understood through a description of examples of embodiments of the invention, and in the following preferred embodiments of the device of the invention are described referring to the drawings, examples of embodiments being shown which, especially with respect to the choice of materials, are adapted to the treatment of molen ferro silicon with oxygen-containing gas. It should be understood that the gas is passed from a gas source (e.g. a pressure container) through a control panel with the required valves and monitoring instruments, through the inlet piping of the device and further through the injection device and into the melt to be tested.

BRIEF DESCRIPTION OF THE DRAWINGS

In FIG. 1 the device is shown mounted in the bottom lining of a melt container, whereas in FIG. 2 the lining is not shown.

In the three drawings the same reference numerals are used for corresponding parts of the device.

DETAILED DESCRIPTION OF THE INVENTION

Figure 1:
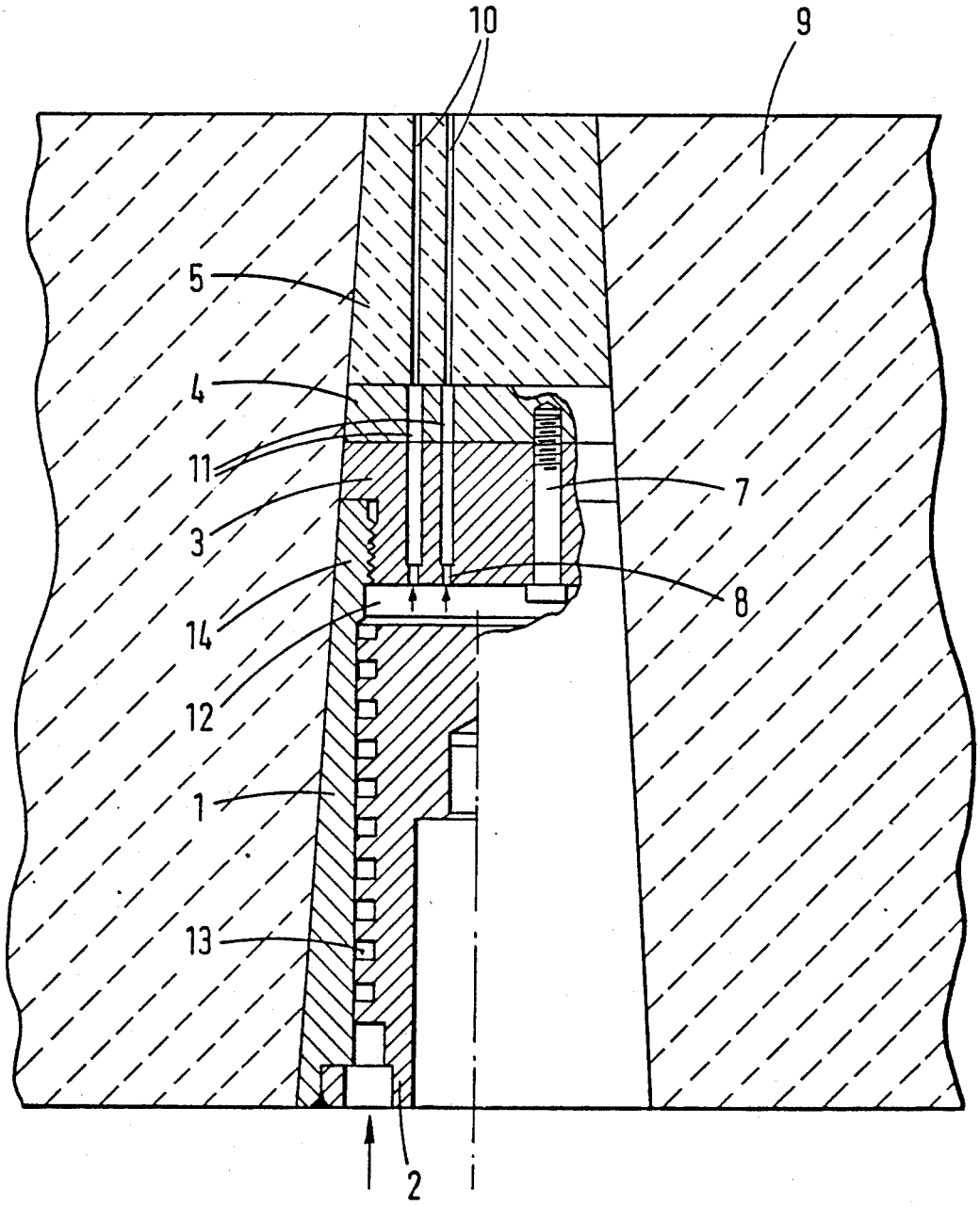
FIGS. 1 and 2 illustrate, partly in section, the injection device of the invention in two alternative embodiments.

FIG. 1 illustrates an embodiment of the device of the invention inserted in the bottom lining 9 of a melt container (now shown). The device comprises a front section 5 having perforations 10 (of which only two are shown), a middle section 3,4 having perforations 11, as well as a rear section 1,2 having a helical duct 13 running through it. The holes 10 of the section 5 correspond with perforations 11 of the middle section 3,4, the perforations 10 and 11 thus forming passages or ducts between the melt and a cavity 12 beneath the middle section 3,4. The cavity 12 communicates with a source of treatment gas through the helical duct 13. Thus, a passage for treatment gas is provided from the external gas source through the duct 13, the perforations 11 and the perforations 10 to the melt.

As the front section 5 will be contacted by the melt it is made of a high melting material, normally a ceramic material, of sufficient resistance to attack by the ferro silicon melt as well as to attack by the treatment gas. The cross section (or the diameter) of the holes 10 (or at least the upper part of each hole) is chosen such that the melt can not readily penetrate down into the holes even when gas is not injected through them. A suitable diameter will normally be 2–3 mm.

The middle section 3,4 comprises a part section 4 of copper or copper alloy and a part section 3 made of steel. The reason why copper or a copper alloy, a metal of high thermal conductivity, is chosen is that high thermal conductivity results in a quick removal of heat from the melt which (for some reason) might penetrate into the device from the melt container, and the penetrating melt will then solidify in the part section 4 and block further penetration. Part section 4 of copper or copper alloy thus comprises a safety measure against the whole device being filled with melt in case melt should break through the front section 5 through one or more of the holes 10 (during an intended or not intended cessation of gas injection) or along the interface between the front section 5 and lining 9 of the melt container, or because of other defects that might occur in the front section 5. The thickness of the part section 4 should be at least 2 cm, desirably more, e.g. 3–4 cm. Optionally, the entire middle section 3,4 may be made of copper or copper alloy; however this is unnecessary, and the middle section 3,4 is therefore shown comprising two part sections of which the rear part section 3 is made of steel. The part sections 3,4 may as illustrated be bolted together by bolts indicated by 7. The lowermost portion of the part section 3 of the middle section has a reduced diameter for connection to the rear section 1,2.

The rear section 1,2, which suitably may be made of steel, is illustrated comprising two parts, an outer or peripheral part 1 and an inner part or core 2. The rear section 1,2 includes the helical duct 13 for supply of treatment gas from the external source to the cavity 12 which is defined by the upper surface of the core 2, the lower surface of the middle section 3,4 and the upper portion 14 of the outer part 1 of the rear section, outer part 14 extending up past the core 2. For connection to the middle section 3,4 portion 14 envelopes the lower portion of the middle section 3,4 and suitably can be screwed onto the latter.

The device of the invention is, as conventional to such devices, preferably generally conical with circular cross section. The parts comprising the device may be assembled in advance, whereupon the complete device may be mounted in the lining 9 of the melt container after said lining has been suitably prepared as well known per se.

Figure 2:
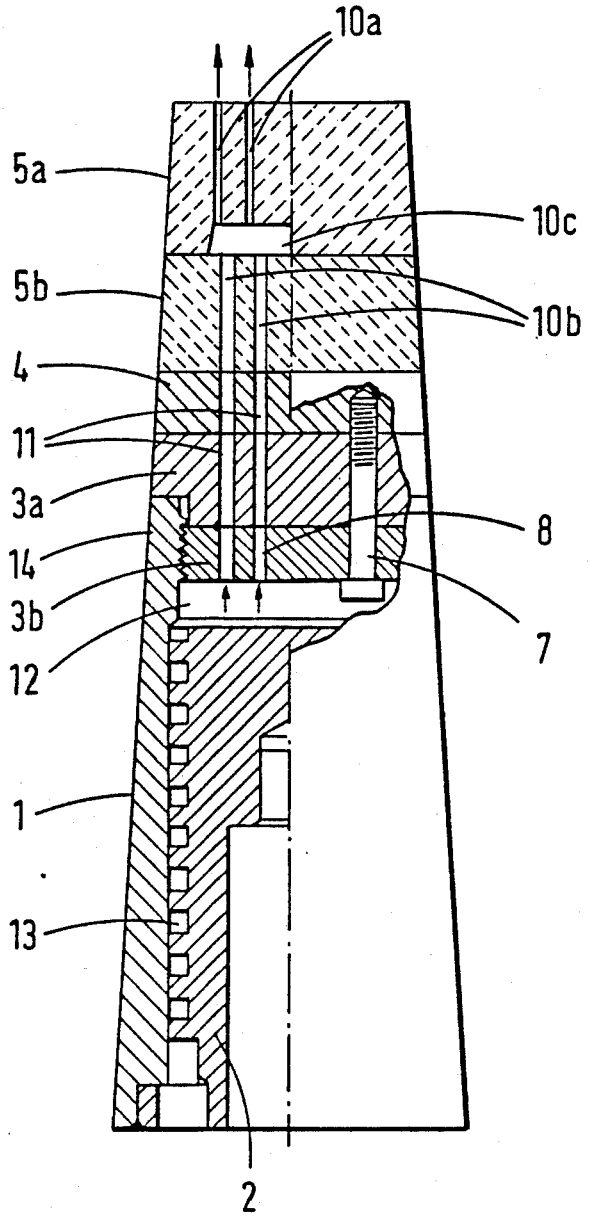

FIG. 2 illustrates an embodiment of the device of the invention wherein the front section 5 is divided into two part sections **5*a* and 5*b* having perforations 10*a* and 10*b*, respectively, that are communicated through a cavity 10*c*. Although not noly the foremost part 5*a*, but also the part 5*b* preferably is made of a ceramic material, the front section may advantageously be diveded into two part sections due to the possibility of the rear section 5*b* being intact even if foremost part section 5*a* must be exchanged after a certain period of operation. Cavity 10*c* entails the advantage that the perforations 10*a* and 10*b* in assembling the parts 5*a* and 5*b*** do not necessarily have to be located in corresponding positions straight opposite each other.

The embodiment of FIG. 2 differs from the one of FIG. 1 also by the part section 3 of the middle section being divided into two parts, **3*a* and 3*b***. This may, depending on the circumstances, facilitate the production of the part section in question.

Figure 3:
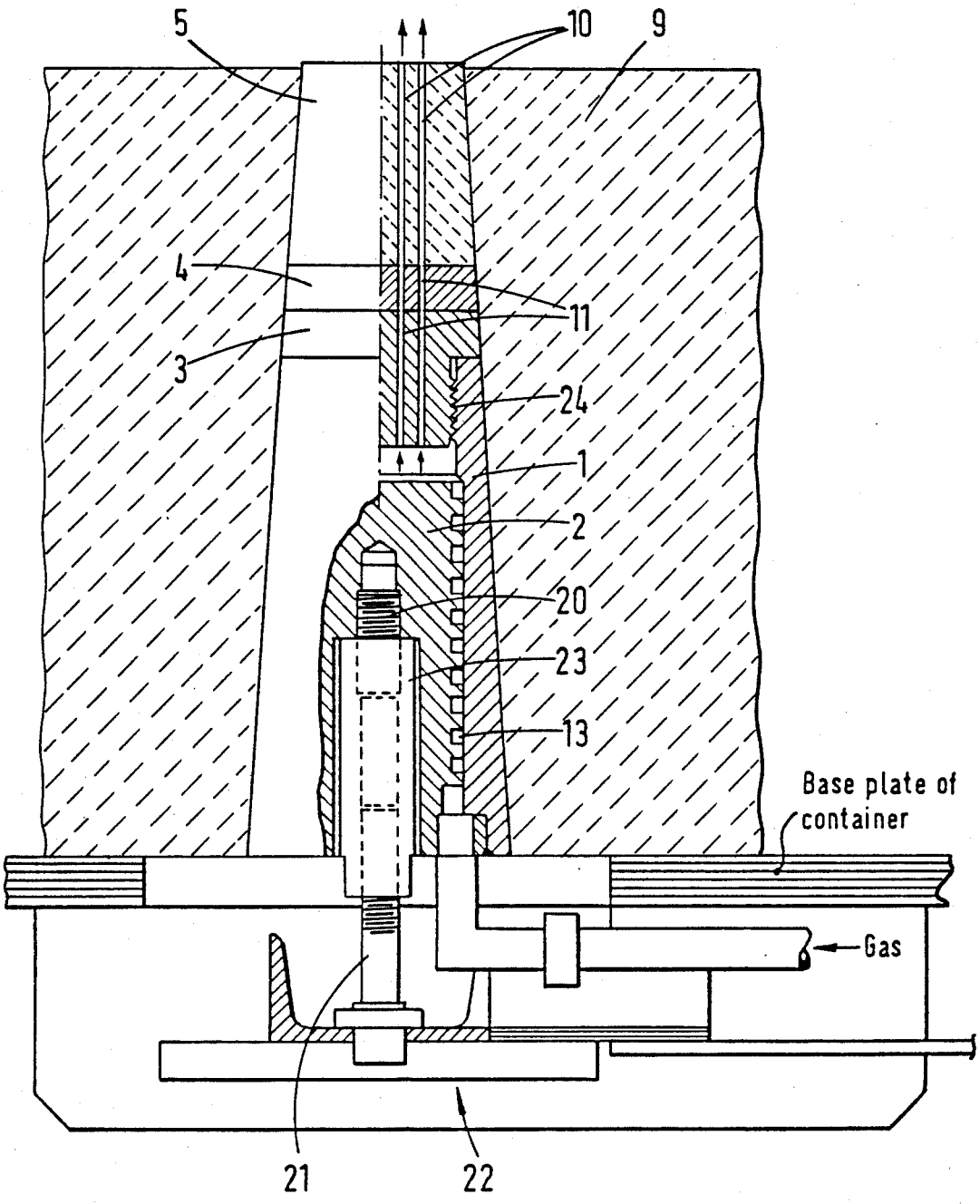
FIG. 3 illustrates, partly in section, the device of the invention mounted in the bottom lining of the melt container and an arrangement to demonstrate a suitable way of mounting the device. Certain details of the upper part of the device are a combination of the embodiments shown in FIGS. 1 and 2.

FIG. 3 illustrates how the mounting of the device of the invention may be suitably effected.

The core 2 of the rear section provided with a helical groove on the peripheral surface and forming the duct 13, is welded to the outer part 1 of the rear section, core 2 being centrally positioned within the peripheral part 1 with the general surface of the core in contact with the inner surface of the outer part, whereby duct 13 is formed. A bolt 20 is shown screwed in centrally from behind (from the bottom) into a bore in the core 2. A bolt 21 supported by a raising/lowering device 22 serves to exert an upward directed pressure against the bolt 20 (when mounting the device of the invention in the bottom lining 9 of the melt container), and also to exercise a downward directed pull on the device (during dismounting), the bolts 20 and 21 being connected by means of an internally threaded casing 23. The middle section 3,4, the parts of which are held together by means of the bolts 7, are screwed into the upper part 14 of the outer part 1 of the rear section at 24, and the front section 5 is placed on the top with perforations 10 and 11 in corresponding position. The whole device may then be moved up into the prepared opening in the container lining by executing appropriate pressure.

When dismounting the device the front section 5, sticking due to baking, will normally not come along, but has to be removed in another way, suitably by drilling out. This is a simple and quick operation using suitable tools. The melt container must then of course be emptied.

The preferable diameter of the perforations 10 will be somewhat dependent on the hydrostatic pressure of the melt at the outlet of the perforations 10, and on the type and characteristics of the melt, such as surface tension and viscosity. The exact establishing of the optimal diameter of perforations 10 is thus a matter of experience in the particular case of use.

The diameter of the perforations 11 of the middle section 3,4 is less critical than in the case of perforations 10, as the middle section is normally not contacted by the melt. Due to the above mentioned desired solidification of melt which, e.g. by accident, might penetrate into perforations 11 the diameter of the perforations 11 should not be too large, and, generally, the diameter suitably may be of the same order of size as the perforations 10.

As previously mentioned copper or a copper alloy is the preferred material for the part section 4 of the middle section. Essential is however that the part section 4 conducts heat well so that melt which might penetrate into the perforations 11 will solidify and prevent further penetration. Therefore, materials other than copper of course can be useful. Alternatively a composite material or a laminate of e.g. steel plates and a mechanically weaker material of better heat conductivity can be employed.

The position of the helical duct 13 through the outer part of rear section 1,2 has turned out to result in a very favourable cooling effect of the injection gas (temperature gradients). The cooling effect is mainly efficacious in the outer parts of the rear section and in the adjacent parts of the lining 9, but may also to a noticeable degree have a favourable cooling effect inward to the middle section 3,4 and adjacent parts of the lining.

The cross section of the duct 13 of the rear section 1,2 may suitably be of the same order of size as the total cross section of the perforations 10 of the front section 5, preferably larger. The total length of the duct 13 will obviously depend on the thickness of the lining 9 in the actual case, as well as the desired distribution of the cooling effect of the injection gas on the different parts of the injection device. Many factors may be of influence here, such as the temperature of the melt, the total thickness of the lining, the heat conductivity of the lining material, the relative length (height) of the three main sections of the device, the choice of material for these, among others. The device of the invention can easily be adapted to the particular case of use.

The device of the invention is believed to be useful for gas injection into any metal melt and similar melts provided that the front section, which is directly exposed to the temperature of the melt and chemical attack, is made of a suitable material. The choice of material will of course depend on the temperature of the melt and the type of melt, possibly also the nature of the gas at the temperatures to be experienced, and the selection of material thus will be within the reach of the person skilled in the art in each case.

Referring to the initially mentioned requirements (a)–(f) it will be seen that a high degree of safety that the melt will not flow out through the injection device is achieved firstly by suitable choice of diameter of the perforations 10 in the front section 5, and secondly in that melt which might penetrate the front section will solidify in the part section 4, thereby blocking further melt penetration. The part section 4 will during injection of gas be cooled by the gas and kept at a relatively low temperature due to the high heat conductivity of the material. Efficient dispersion of gas in the melt is achieved due to the relatively low gas flow resistance of the device of the invention and the fact that the perforations 10 of the front section 5 can readily be arranged in the desired pattern, including perforations having different directions and optionally somewhat different diameters.

The requirement of flexibility of capacity mentioned under item c, is met by the possibility of selection of hole diameter, number of holes and working pressure of the injection gas.

The requirement of long life of the injection device mentioned under item d, is primarily met by selection of a suitable refractory material for the front section, but also by the cooling effect resulting from a gas flow through the disclosed device of the invention.

The requirement of possibility of simple and quick replacement from the exterior wall/base of the container mentioned under item e is met by the fact that the outer surfaces of the injection device can readily be treated with suitable sealing/release agents during mounting, the rear and middle sections of the injection device can be retracted from their positions in the container lining by screw means in connection with the device 22 shown in FIG. 3, which during operation of the injection assembly also keeps the injection device in position in the container lining, when required the front section of the device can quickly be removed by drilling and a new front section installed.

The requirement of adaptation possibilities mentioned under item f is met by the feasibility of manufacturing the three main sections of the device to have specific, desired length and diameter dimensions.

As is apparent from the above, the device of the invention may, substantially, be made of steel, suitably common carbon steel, which is considered to be an advantageous feature

We claim:

1. Device for injecting gas into a hot melt, particularly molten metal, which device is suitable for being installed in the wall, particularly the bottom wall, of the container holding the melt, wherein said device comprises three main sections including:

a front section of refractory material which is resistant to the hot melt and which has a number of perforations for introduction of gas into the melt, a middle section which at least partly consists of heat conductive material and possesses a number of perforations communicating with the perforations of the front section, and a rear section at least an outer part of which is of heat conducting material, which rear section in or close to its peripheral parts has a helical duct communicating with the perforations of the middle section and adapted to pass said gas from an external gas source into the hot melt.

2. Device according to claim 1, wherein said front section is divided into two part sections of which at least a foremost said part section is made of a refractory material, and the perforations of said foremost part section communicate with the perforations of the other part section through a cavity.

3. Device according to claim 1, wherein said middle section is divided into two part sections of which at least a foremost said part section is made of a material having high heat conductivity.

4. Device according to claim 3, wherein said foremost part section of the middle section is made of copper or a copper alloy.

5. Device according to claim 3, wherein a rear part section of the middle section is made of steel.

6. Device according to claim 1, wherein the perforations of the middle section are lined by piping of a material of high resistance to chemical attack by the treating gas.

7. Device according to claim 1, wherein said rear section comprises a central core and an outer or peripheral part surrounding the core and having a foremost end which extends beyond the core.

8. Device according to claim 7, wherein said helical duct is formed by a helical groove in the side walls of the core.

9. Device according to claim 1, wherein the helical duct of the rear section communicates with the perforations of the middle section through a cavity in the foremost end of the rear section.

10. Device according to claim 1, wherein the rear (lower) part of the middle section and the foremost (upper) part of the rear section are provided with threads for screwing together said two sections.

* * * * *